US007422008B1

(12) United States Patent
Tentler et al.

(10) Patent No.: US 7,422,008 B1
(45) **Date of Patent: *Sep. 9, 2008**

(54) STRAP FOR BOW STRING RELEASE

(75) Inventors: Steve Tentler, Fond du Lac, WI (US); Lynn A. Tentler, Cape Coral, FL (US)

(73) Assignee: Tru-Fire Corporation, North Fond Du Lac, WI (US)

( * ) Notice: Subject to any disclaimer, the term of this patent is extended or adjusted under 35 U.S.C. 154(b) by 533 days.

This patent is subject to a terminal disclaimer.

(21) Appl. No.: 10/662,989

(22) Filed: Sep. 15, 2003

(51) Int. Cl.
*F41B 5/18* (2006.01)

(52) U.S. Cl. ..... 124/35.2

(58) Field of Classification Search ..... 2/321, 2/322; 24/188, 189; 124/35.2; 224/164, 224/166, 221, 222, 267; 119/863, 864
See application file for complete search history.

(56) References Cited

U.S. PATENT DOCUMENTS

| | | | | | |
|---|---|---|---|---|---|
| 2,041,944 | A | * | 5/1936 | Mestekin | 63/3 |
| 2,394,856 | A | * | 2/1946 | Hickman | 224/178 |
| 2,420,435 | A | * | 5/1947 | Lackow | 224/164 |
| 2,440,728 | A | * | 5/1948 | Siegel | 63/3 |
| 2,449,885 | A | * | 9/1948 | Domler | 224/164 |
| 2,453,010 | A | * | 11/1948 | Graffin | 119/864 |
| 2,798,458 | A | * | 7/1957 | Odermatt | 119/858 |
| 2,929,372 | A | | 3/1960 | Vance | |
| 2,936,749 | A | | 5/1960 | Chellstorp | |
| 2,996,059 | A | * | 8/1961 | Vance | 124/35.2 |
| 3,011,478 | A | * | 12/1961 | Kirby | 119/864 |
| 3,028,852 | A | | 4/1962 | Sutton, Jr. | |
| 3,072,115 | A | * | 1/1963 | Johnson | 124/35.2 |
| 3,604,407 | A | | 9/1971 | Wilson | |
| 3,815,908 | A | | 6/1974 | Hashimoto | |
| 4,047,250 | A | | 9/1977 | Norman | |
| 4,160,437 | A | | 7/1979 | Fletcher | |
| 4,193,135 | A | | 3/1980 | Rhee | |
| 4,426,989 | A | * | 1/1984 | Sutton | 124/35.2 |
| 4,509,497 | A | * | 4/1985 | Garvison | 124/35.2 |
| 4,831,997 | A | | 5/1989 | Greene | |
| 4,909,232 | A | | 3/1990 | Carella | |
| 4,938,487 | A | | 7/1990 | Ponsart | |
| 4,958,758 | A | * | 9/1990 | Tipple et al. | 224/267 |
| 4,981,128 | A | | 1/1991 | Garvison | |
| 5,014,689 | A | | 5/1991 | Meunchen et al. | |
| 5,020,508 | A | | 6/1991 | Greene, Jr. | |
| 5,261,581 | A | | 11/1993 | Harden, Sr. | |

(Continued)

OTHER PUBLICATIONS

Article from website www.trufire.com entitled "Tru-Fire Release Guide", Sep. 15, 2003, 2 pgs.

(Continued)

*Primary Examiner*—John Ricci
(74) *Attorney, Agent, or Firm*—Gerald E. Helget; Nelson R. Capes; Briggs and Morgan, P.A.

(57) ABSTRACT

A strap for a bow string release is provided to form a semi-closed (or open) hand receiving condition wrist strap for facilitating quick attachment and detachment of the strap to the wrist. The strap facilitates one-handed coupling about an archers wrist by selectively maintaining the semi-closed (or semi-open) hand receiving condition so that the archer does not have to manually insert a first end of the strap through a second end of the strap.

26 Claims, 5 Drawing Sheets

U.S. PATENT DOCUMENTS

| | | | | | |
|---|---|---|---|---|---|
| 5,323,754 | A | | 6/1994 | Pittman | |
| 5,595,167 | A | | 1/1997 | Scott | |
| 5,615,662 | A | | 4/1997 | Tentler et al. | |
| 5,857,452 | A | | 1/1999 | Troncoso | |
| 5,937,841 | A | * | 8/1999 | Summers et al. | 124/35.2 |
| 6,125,833 | A | * | 10/2000 | Tentler et al. | 124/35.2 |
| 6,129,055 | A | * | 10/2000 | Hanada | 119/863 |
| 6,205,991 | B1 | | 3/2001 | Summers et al. | |

OTHER PUBLICATIONS

"T.R.U. Ball Release Products" catalog, 1996; p. 6.
"HHA Sports 1997 Archery Catalog", 1997; pp. 8, 9.
"T.R.U. Ball Release Products" catalog, 1998; p. 4.

* cited by examiner

STRAP FOR BOW STRING RELEASE

RELATED APPLICATION

This application claims the benefit of co-pending patent application Ser. No. 10/646,358 filed 22 Aug. 2003.

BACKGROUND OF THE INVENTION

The invention is generally related to bow string releases and is specifically directed to a strap for a release.

Bow string releases are well known in the industry. Typically, a bow string release is designed to engage and lock a bow string in a mechanical sear for allowing the archer to pull the bow to its maximum draw. A trigger mechanism is then used to unlock the sear mechanism and release the string to fire the arrow.

As is typical, most bow string releases are secured to the wrist of the archer, permitting the release to be held in an at ready position while, freeing the fingers of the hand for other tasks. Also, by attaching the release to the archer at the wrist area, the amount of strain on the hand is greatly decreased when high draw weight bows are utilized, which is typical in archery hunting and archery tournaments. Many various straps and harnesses are available for bow string releases. An example of a widely accepted V-type strap is shown in U.S. Pat. No. 4,831,997 entitled: Wrist Strap, issued to Greene, on May 23, 1989. The strap has two ends that are placed around the wrist and then attached to secure the release strap and release to the wrist of the archer.

One mechanism to couple the strap about the archer's wrist is to provide a receiver on a first end of the strap. The archer then must manipulate the second end of the strap through the receiver, and then place a pin on the receiver through a hole provided on the second end of the strap, similar to operation of a belt worn around a waist.

Many currently available straps for bow string releases are difficult for the archer to couple about their wrist. This is because the strap remains proximal to the archers shooting hand, preventing the archer from using their shooting hand to assist the archer's off-hand in manipulating the strap. It has proven difficult for archers to one-handedly manipulate the second end of the strap through the receiver, and then place the pin on the receiver through the hole provided on the second end of the strap.

Additionally, repeated placement of the pin on the receiver through the hole provided on the second end of the strap cause the hole to stretch during repeated drawing of the bow during use. This stretch causes the hole on the second end of the strap to disadvantageously expand.

SUMMARY OF THE INVENTION

This invention relates to an improved strap for a bow string release. According to preferred embodiments of the present invention, the strap has two ends, a first end and a second end. The first end of the strap is provided with a receiver for receiving a tab that is coupled with the second end of the strap.

Preferably, the tab on the second end of the strap is sized to allow the archer to place the tab of the second end through the receiver of the first end of the strap, and have the tab of the second end selectively remain through the receiver of the first end of the strap. This allows the archer to have the ability to have the second end of the strap already started through the receiver of the first end of the strap, easing the way in which archers couple the strap to their wrist.

According to another aspect of the present invention, the strap is constructed in multi-layer fashion, a first padded layer that provides comfortable contact with the archer's skin, among other benefits, and a second non-stretchable layer that provides the strap with a robust design that prevents the strap from stretching, and prevents holes in the strap from expanding through repeated use, among other benefits.

DESCRIPTION OF THE PREFERRED EMBODIMENT

Although the disclosure hereof is detailed and exact to enable those skilled in the art to practice the invention, the physical embodiments herein disclosed merely exemplify the invention that may be embodied in other specific structure. While the preferred embodiment has been described, the details may be changed without departing from the invention, which is defined by the claims.

Figure 1:
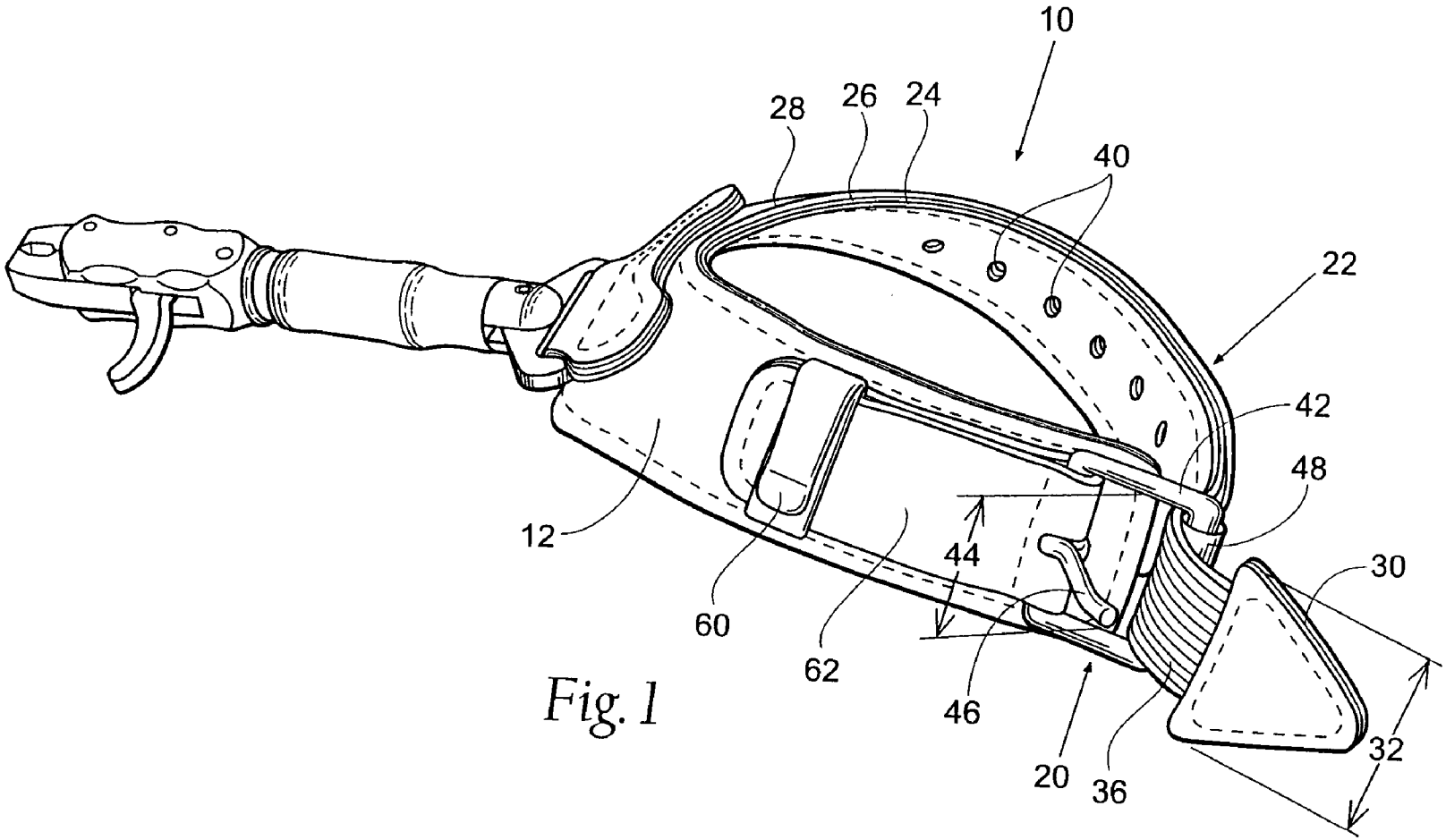
FIG. 1 is a perspective view of a preferred embodiment of a strap for a bow string release.

Referring now to FIG. 1, a perspective view of a preferred embodiment of a strap 12 for a bow string release 10 is shown. The strap 12 has two ends, a first end 20 and a second end 22. It is noted that reference to either the first end 20 or the second end 22 refers generally to the last segments of the strap 12, not to the absolute extremities of the strap 12. The first end of the strap 12 is provided with a receiver 42 for receiving a tab 30 that is coupled with the second end 22 of the strap 12.

Preferably, the tab on the second end 22 of the strap 12 is sized to allow the archer to place the tab 30 of the second end 22 through the receiver 42 of the first end 20 of the strap 12, and have the tab 30 of the second end 22 selectively remain through the receiver 42 of the first end 20 of the strap 12. This allows the archer to have the ability to have the second end 22 of the strap 12 already started through the receiver 42 of the first end 20 of the strap 12, easing the way in which archers couple the strap 12 to their wrist. It is understood that the first end may refer to either end of the strap, as long as the strap has two ends.

It is preferable to shape the tab 30 as a triangle, as shown, in order to ease folding of the tab 30 to fit through the receiver 42, although other shapes may be readily used.

The receiver 42 is coupled with a receiver pin 46 which can be inserted into holes 40 on the strap 12, belt fashion. The receiver 42 also preferably has a receiver roller 48 to facilitate sliding of the second end of the strap 22 through the receiver 42. It should be understood that other means for maintaining the second end 22 in a semi-closed position relative to said first end 20 may be used, such as a hook and loop attachment.

Still referring to FIG. 1, but also shown in FIGS. 2-6, according to another aspect of the present invention, the strap 12 is constructed in multi-layer fashion, a first preferably padded layer 24 that provides comfortable contact with the archer's skin. A second non-stretchable layer 26 prevents the strap 12 from stretching, and also advantageously prevents holes 40 in the strap 12 from expanding through repeated use and placing of a pulling load on the holes 40 by a receiver pin 46. Preferably, the second layer 26 is formed with a nylon ballistic material. Optionally, a third layer 28 is provided on the outermost portion of the strap 12, the third layer 28 preferably formed from a material such as leather to give the strap 12 an appealing appearance. Common techniques for fabric coupling include sewing and adhesives, although any suitable coupling mechanism can be used.

The shape of the strap 12 is shown in a V-shaped pattern, although the strap 12 can take on other configurations to suit the archers wrist.

Figure 2:
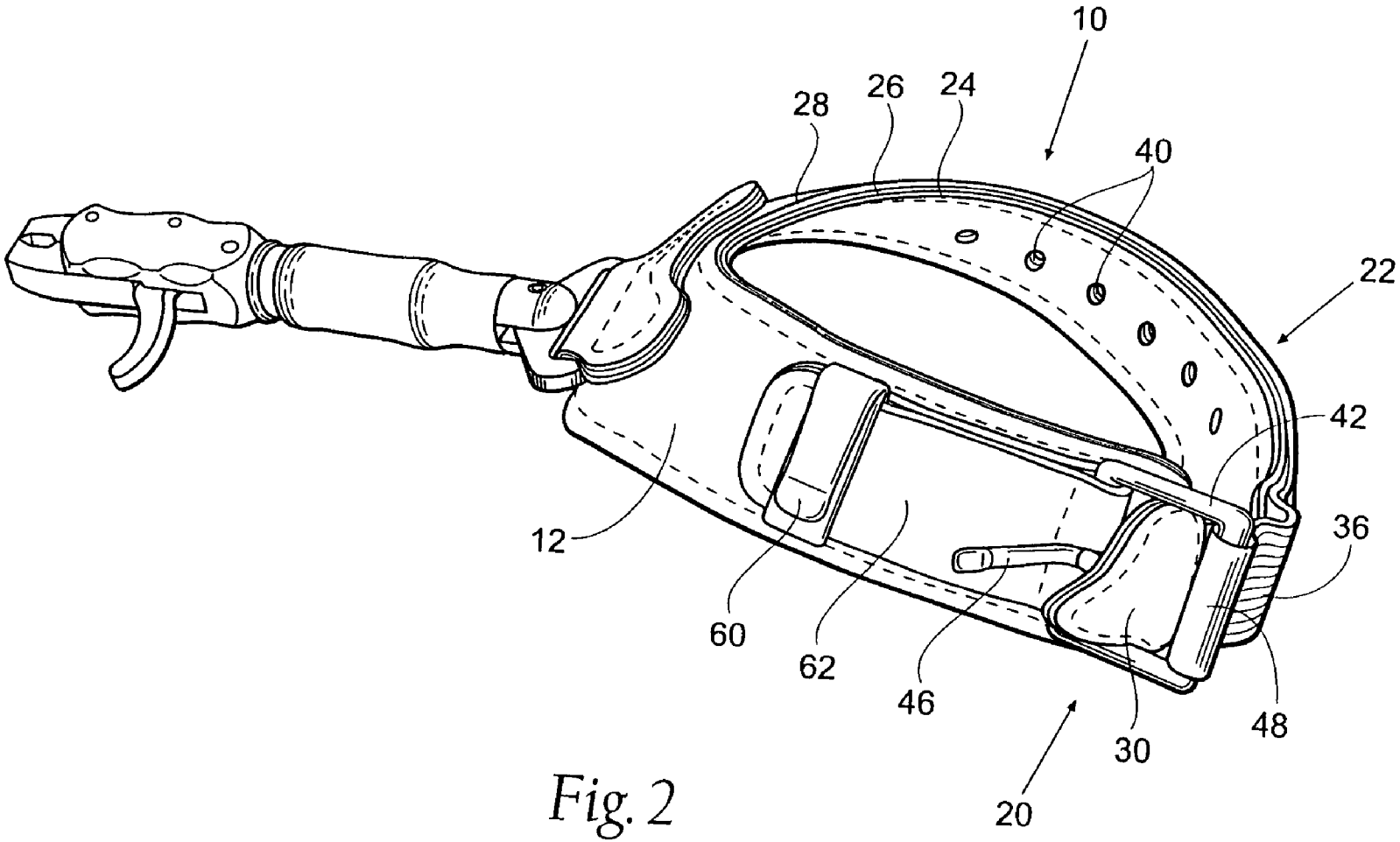
FIG. 2 is a perspective view of a preferred embodiment of a strap for a bow string release, the strap coupled about an archers wrist, the strap in an open position.

Referring now to FIG. 2, the strap 12 is shown coupled about an archers wrist, the strap 12 in an open position as shown. In this open position, the second end of the strap 22 has been withdrawn from the receiver 42 by flexing the tab 30 to decrease its effective width from its ordinary strap width 32, which is preferably greater than the width 44 of the receiver, until the strap width 32 is decreased by folding or otherwise, as shown in FIG. 2. It is believed that archers will prefer to keep the strap 12 in a semi-open position when the release is not in use, as described with relation to FIG. 1, in order to avoid having to manipulate the second end 22 of the strap 12 through the receiver 42.

Figure 3:
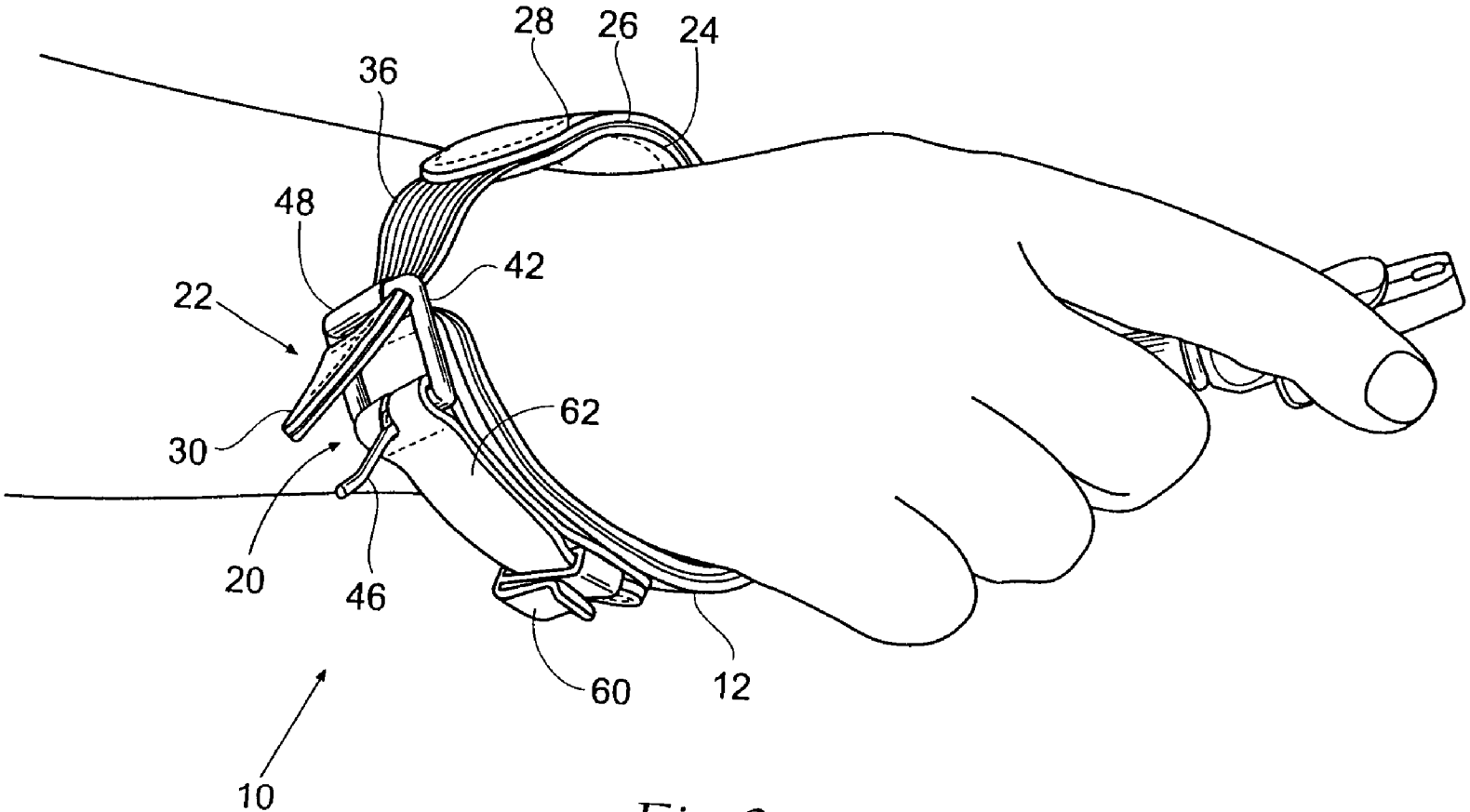
FIG. 3 is a perspective view of a preferred embodiment of a strap for a bow string release, the strap coupled about an archers wrist, the strap in a semi-closed (or open) position.

Referring now to FIG. 3, the strap 12 is shown in a semi-open position. In this position, the archer has initially placed his wrist into the strap 12, but has not yet coupled the receiver pin 46 into any one of the holes 40 (not visible in FIG. 3).

Figure 4:
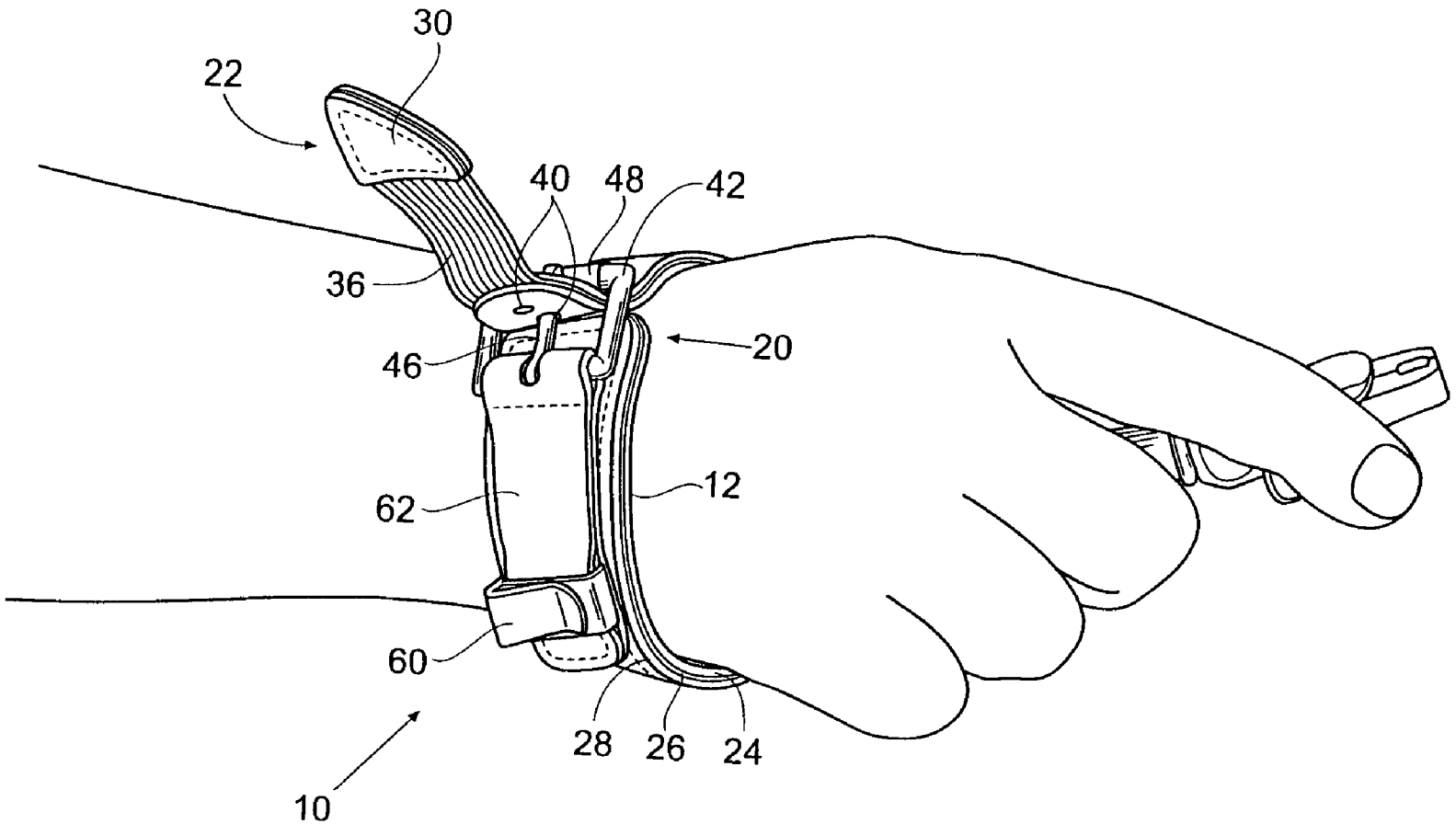
FIG. 4 is a perspective view of a preferred embodiment of a strap for a bow string release, the strap coupled about an archers wrist, the strap in a closed position.

Referring now to FIG. 4, the strap 12 is shown in a closed position. In this position, the archer has initially placed his wrist into the strap 12, and has now coupled the receiver pin 46 into any one of the holes 40 to secure the strap about the wrist.

Figure 5:
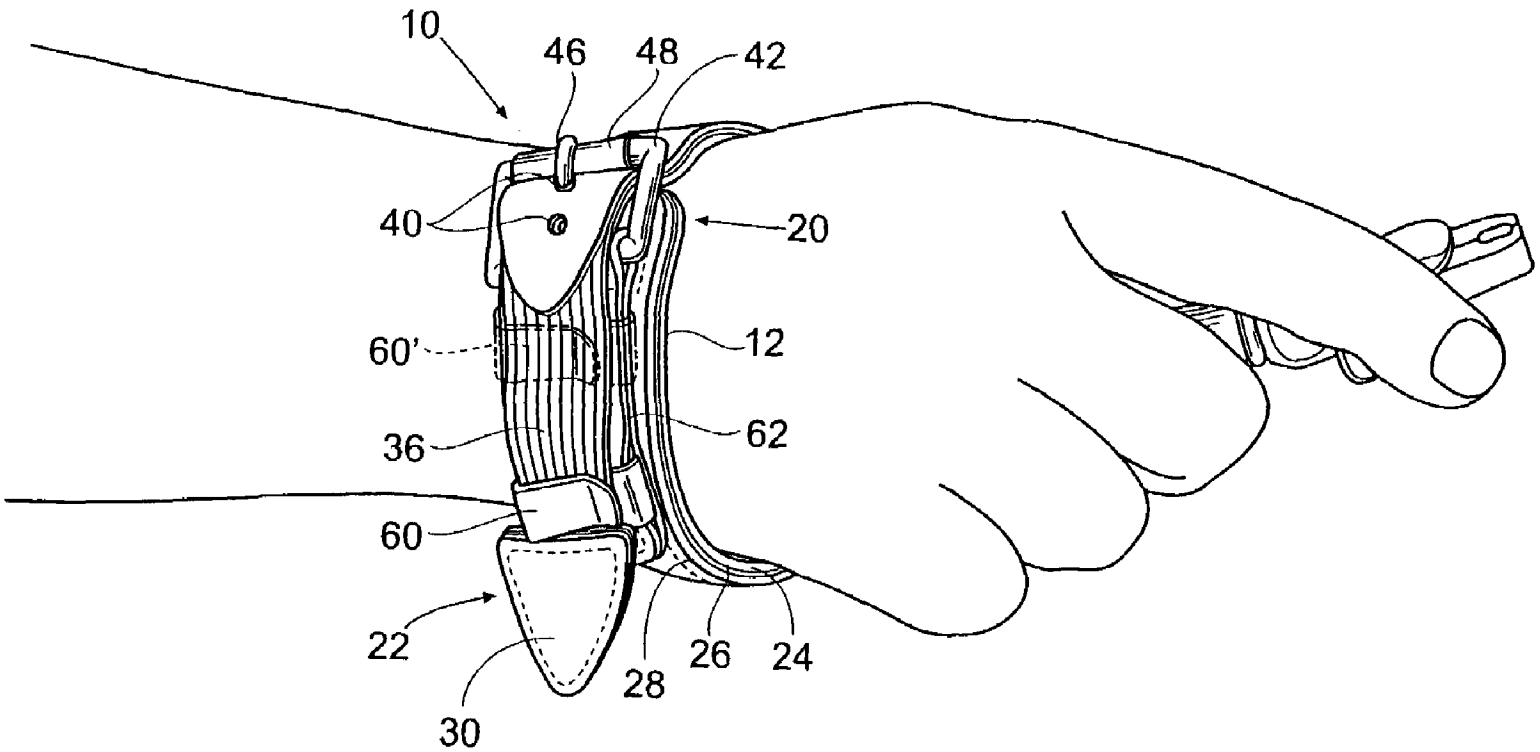
FIG. 5 is a perspective view of a preferred embodiment of a strap for a bow string release, the strap coupled about an archers wrist, the strap in a closed position, and a tab of the strap in a restrained position.

Referring now to FIG. 5, the strap 12 is shown coupled about an archers wrist, the strap in a closed position as described in relation to FIG. 5, and the tab 30 of the strap 12 in a restrained position. In this restrained condition, a portion of the second end of the strap 22, preferably the elastic member 36, has been placed into clip 60. The first end of the strap 20 has a clip 60 coupled to the strap 12 by a clip receiver strap 62. The clip receiver strap 62 preferably allows the clip 60 to slide laterally to engage the tab 30 for a wide variety of wrist sizes, and to keep the second end of the strap 22 relatively secured to the strap 12 itself. The clip 60 is also shown in a second position 60' although the clip 60 preferably has the capability to slide along a range of lengths along the receiver strap 62. The elastic member 36 enables the second end of the strap 22 to be restrained, yet avoids the receiver pin 46 from being inadvertently withdrawn from a hole 40, as could be possible with an archer having a large wrist size.

It is understood that alternative embodiments of the present invention could also be employed to selectively maintain the second end 22 of the strap 12 through first end 20 of the strap, said alternative embodiments not shown in the drawings. This could be accomplished by having a piece of cord fasted to the second end 22, and then weaving the cord through the receiver. Alternatively, an elastic member could be coupled with the first end 20, and then coupled with the second end 22.

The foregoing is considered as illustrative only of the principles of the invention. Furthermore, since numerous modifications and changes will readily occur to those skilled in the art, it is not desired to limit the invention to the exact construction and operation shown and described. While the preferred embodiment has been described, the details may be changed without departing from the invention, which is defined by the claims.

We claim:

1. A strap for a bow string release comprising:

a strap having a first end and a second end;

said first end of said strap comprising a receiver having an opening for receiving said second end, said opening having an opening width;

said second end of said strap comprising a member having a width, said member width greater than said opening width; and said strap coupled to a bow string release mechanism.

2. A strap according to claim 1, the second end of said strap further comprising an elastic member coupled with said member.

3. A strap according to claim 1, the strap further comprising a clip coupled to said strap, said clip being coupled with the second end of said strap.

4. A strap according to claim 1, the strap further comprising a clip coupled to said strap, said clip being selectively coupled with the second end of said strap.

5. A strap according to claim 1, the strap further comprising a clip receiver coupled to said strap, and a clip coupled to said clip receiver.

6. A strap according to claim 5 where said clip is movably coupled with said clip receiver.

7. A strap according to claim 1, said second end of strap further comprising at least one hole provided on said strap, said hole selectively receiving a pin coupled with said receiver on said first end of said strap.

8. A strap according to claim 1, wherein said member is triangular.

9. A strap according to claim 1, said strap being formed from a first padded layer coupled to a second non-stretchable layer.

10. A strap according to claim 9, the strap further comprising a third layer coupled with said second layer.

11. A strap according to claim 9, wherein said second layer is formed of a ballistic material.

12. A strap according to claim 1, said strap comprising a substantially v-shaped pattern.

13. A strap according to claim 1, said member comprising a substantially triangular pattern.

14. A multi-layer strap for a bow string release adapted to contact an archer's skin comprising:

a padded layer adapted to lie adjacent to the skin; and a substantially non-stretchable layer overlaying said padded layer, on the surface of the padded layer not adjacent to the skin, over substantially all of the padded layer, the strap being connected to a bow string release.

15. A strap for a bow string release according to claim 14, said strap further comprising a third layer coupled with said substantially non-stretchable layer.

16. A strap for a bow string release comprising a substantially v-shaped strap having a first end and a second end, said second end being provided with a means for maintaining the second end in a semi-closed position relative to said first end, wherein said means for maintaining the second end in a semi-closed position relative to said first end is removable from said first end.

17. A strap for a bow string release comprising a first end of said strap, a second end of said strap, said first end and said second end in a semi-closed relationship and said first end being removable from said second end, said first end having a receiver and said second end being insertable into the receiver and removable from the receiver, and the receiver maintaining the second end in the semi-closed relationship.

18. A strap according to claim 17, said first end and said second end further forming a closed relationship.

19. A strap for a bow string release, the strap having a buckle/pin type construction, the strap having a first end with a receiver and a pin and a second end insertable into the receiver and removable from the receiver, the receiver having a width, and further comprising a means to selectively maintain the second end in a semi-closed position wherein the pin is not engaged with the second end but the strap does not fall off the archer's wrist and an open position relative to the first end.

20. A strap according to claim 19, wherein the means to selectively maintain the second end in a semi-closed position relative to the first end is a member having a width not greater than the width of the receiver.

21. A strap according to claim 19, wherein the means to selectively maintain the second end in a semi-closed position relative to the first end is a tab on the second end insertable into the receiver.

22. A strap according to claim 21, wherein the tab is triangularly shaped.

23. A strap according to claim 21, further comprising a clip restraining the second end against the first end.

24. A strap according to claim 23, wherein the clip is adjustable along the first end for different wrist sizes.

25. A strap according to claim 24, further comprising an elastic member on the second end between the first end and the tab and the elastic member being insertable into the clip.

26. A strap for a bow string release comprising:

a strap having a first end and a second end;

said first end of said strap comprising a receiver having an opening for receiving said second end, said opening having an opening width;

said second end of said strap comprising a member having a width, said member width greater than said opening width, said member being selectively coupled to said receiver.

* * * * *